US007214908B2

(12) United States Patent
Wlodarczyk

(10) Patent No.: US 7,214,908 B2
(45) Date of Patent: May 8, 2007

(54) GLOW PLUG INTEGRATED PRESSURE SENSOR WITH FILTER TRAP

(76) Inventor: Marek T. Wlodarczyk, 6865 Vachon Dr., Bloomfield Hills, MI (US) 48301

( * ) Notice: Subject to any disclaimer, the term of this patent is extended or adjusted under 35 U.S.C. 154(b) by 0 days.

(21) Appl. No.: 11/191,601

(22) Filed: Jul. 28, 2005

(65) Prior Publication Data

US 2007/0023412 A1 Feb. 1, 2007

(51) Int. Cl.
*F23Q 7/22* (2006.01)

(52) U.S. Cl. ..... 219/270; 123/145 A; 123/145 R; 73/705; 73/756; 73/116

(58) Field of Classification Search ..... 219/270, 219/544; 123/145 A, 145 R
See application file for complete search history.

(56) References Cited

U.S. PATENT DOCUMENTS 6,122,971 A * 9/2000 Wlodarczyk ..... 73/705
6,575,039 B2 * 6/2003 Murai et al. ..... 73/756
6,923,042 B2 * 8/2005 Hiramatsu ..... 73/35.12
6,973,820 B2 * 12/2005 Watarai et al. ..... 73/35.13
6,979,801 B2 * 12/2005 Okazaki et al. ..... 219/270

* cited by examiner

*Primary Examiner*—Robin Evans
*Assistant Examiner*—Vinod Patel
(74) *Attorney, Agent, or Firm*—James M. Deimen

(57) ABSTRACT

In an integrated glow plug and pressure sensor having a passage leading to the pressure sensor, a porous filter is inserted in the passage. The porous filter provides a four-fold improvement in pressure measurement by (1) acting as a trap for combustion deposits, (2) burning combustion deposits when the glow plug heater is on, (3) acting as a heat shield for reducing thermal shock error of the pressure sensor, and (4) damping acoustic high frequency ringing associated with the pressure passage.

16 Claims, 3 Drawing Sheets

FIG 1
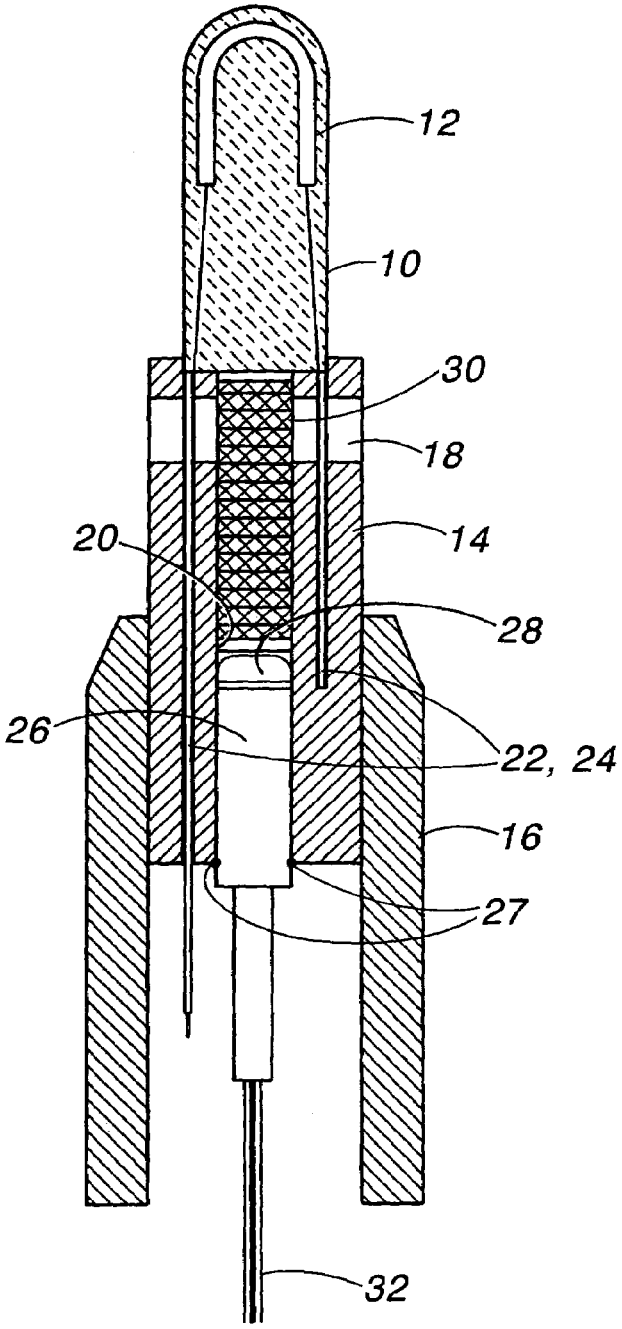
FIG 1A
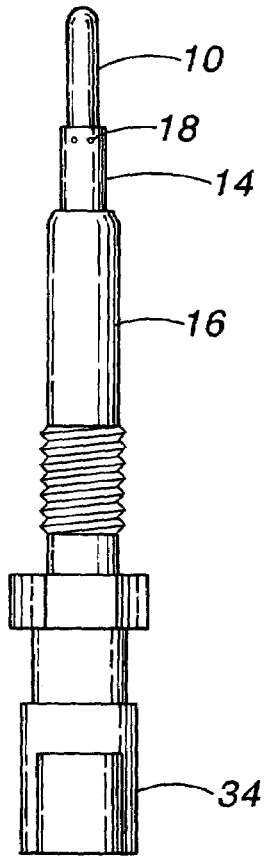
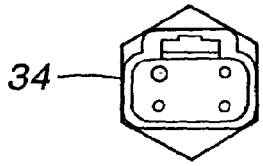
FIG 1B

FIG 2
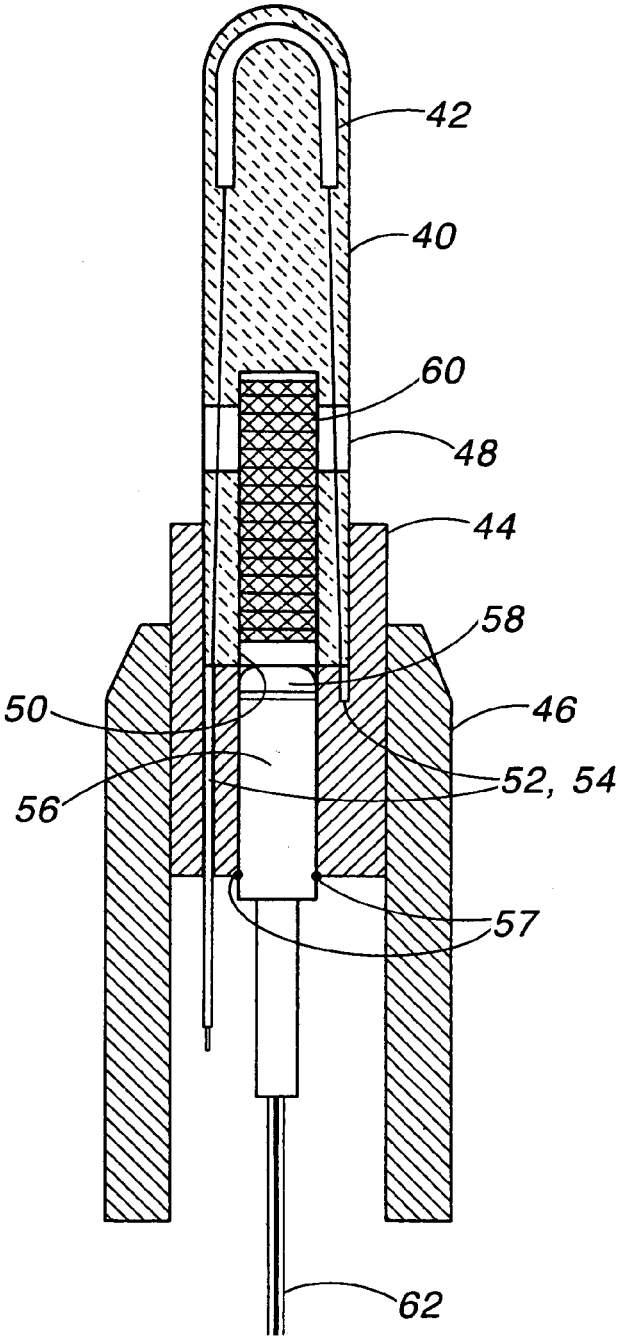
FIG 2A
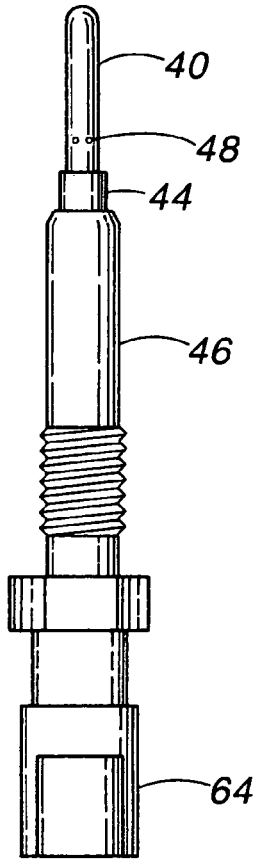
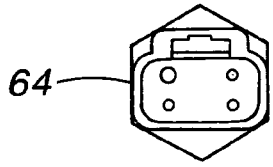
FIG 2B

FIG 3
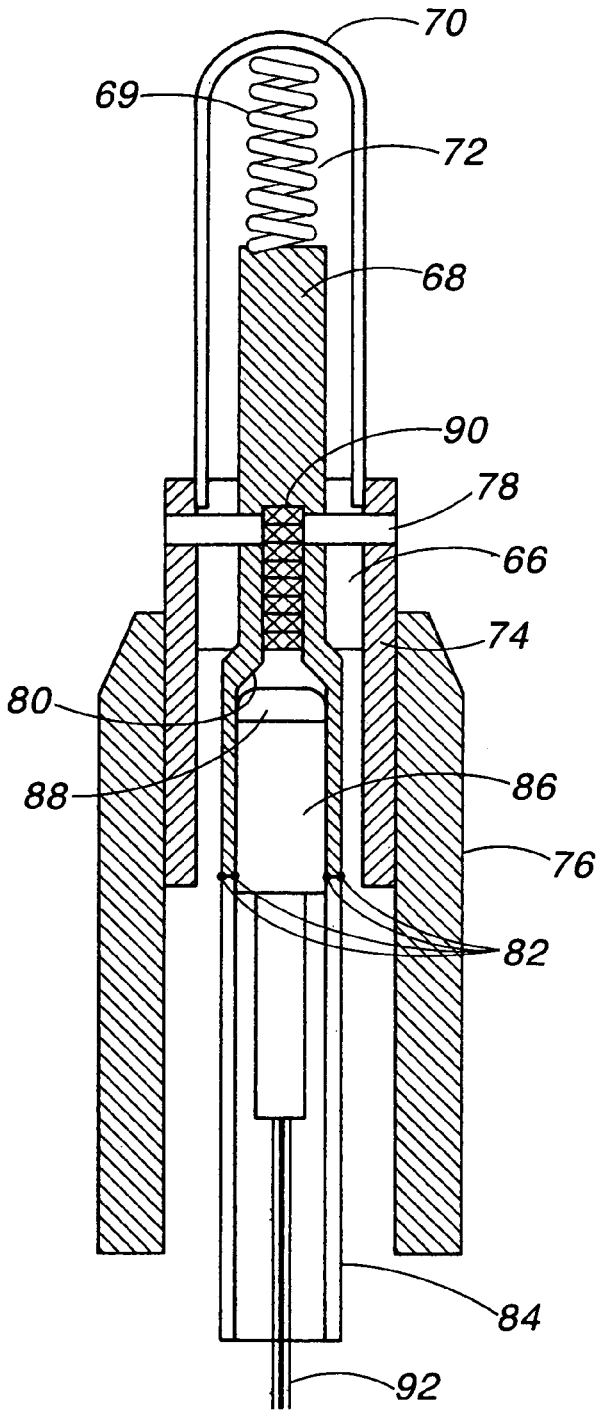
FIG 3A
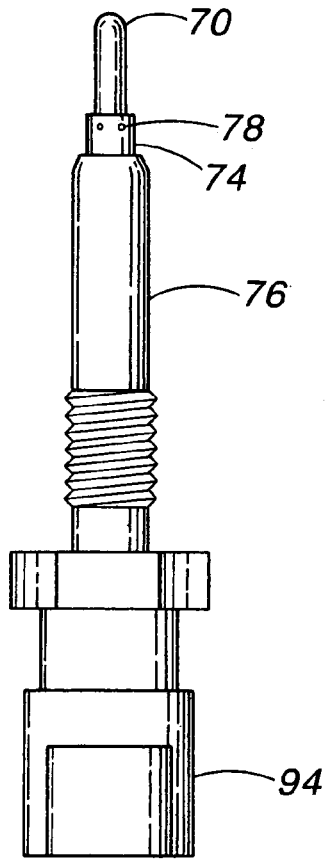
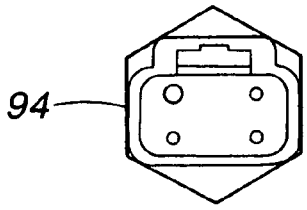
FIG 3B

GLOW PLUG INTEGRATED PRESSURE SENSOR WITH FILTER TRAP

This application claims the benefit of Provisional Application No. 60/581,310, filed Jun. 17, 2004.

BACKGROUND OF THE INVENTION

The field of the invention pertains to pressure sensors for measuring in real time pressure inside internal combustion chambers in engines and, in particular, fiber optic pressure sensors in spark plugs and glow plugs.

By providing an aperture in a glow plug for a fiber optic pressure sensor, a separate aperture into the combustion chamber is not necessary. However, the glow plug environment can be extreme with instantaneous temperatures in thousands of degrees Fahrenheit, rapid cyclic pressure changes and befouling combustion products. To control some of the effects of the extreme environment and provide more accurate pressure measurements over long-term operation, the following improvements to glow plug integrated pressure sensors have been developed.

SUMMARY OF THE INVENTION

The aperture or axial pressure passage of the integrated glow plug and pressure sensor is provided with a porous filter inserted therein. The purpose of the filter is four-fold: (1) the filter acts as a trap for combustion deposits, (2) the filter burns combustion deposits when the glow plug heater is on, (3) the filter acts as a heat shield for reducing thermal shock error of the pressure sensor, and (4) the filter damps acoustic high frequency ringing associated with the pressure passage.

The filter is preferably made of a corrosion-resistant wire mesh, such as already used in diesel particulate filters. The wire mesh filter can be easily modified in dimensions and porosity to accomplish all of the four functions above. With the radial pressure access hole located in the glow plug section that heats to over 600° C., the combustion deposits burn out whenever the glow plug is turned on. As an alternative, the filter may be made of a suitably porous ceramic material.

BRIEF DESCRIPTION OF THE DRAWINGS

FIG. 1 is a partial cross-section of a first version of the integral glow plug;

FIG. 1*a* is an external view of the first version of the integral glow plug;

FIG. 1*b* is an external view of the socket end of the first version of the integral glow plug;

FIG. 2 is a partial cross-section of a second version of the integral glow plug;

FIG. 2*a* is an external view of the second version of the integral glow plug;

FIG. 2*b* is an external view of the socket end of the second version of the integral glow plug;

FIG. 3 is a partial cross-section of a third version of the integral glow plug;

FIG. 3*a* is an external view of the third version of the integral glow plug; and FIG. 3*b* is an external view of the socket end of the third version of the integral glow plug.

DESCRIPTION OF THE PREFERRED EMBODIMENTS

Illustrated in FIGS. 1, 1*a* and 1*b* is a glow plug having a ceramic heater shell 10 with a resistance heater 12 therein. Supporting the ceramic heater shell 10 is a metal heater sleeve 14 in turn supported by the glow plug shell 16. A plurality of radial pressure access holes 18 are formed in the metal heater sleeve 14 and communicate with a central axial passage or hole 20 through the metal heater sleeve. Separate axially directed holes are provided for the heater wires 22 and 24 leading to the resistance heater 12.

Located within the central axial hole 20 is a fiber optic pressure sensor 26 laser welded into the hole at 27 and having a sensor diaphragm 28. Also located in the central axial hole 20 is a porous filter 30 of cylindrical shape. The porous filter 30 covers the radial pressure access holes 18 from the inside such that the sensor diaphragm 28 is only exposed to gases that have passed through the filter 30.

The porous filter 30 is preferably made of a high-temperature-resistant metal, such as high nickel stainless steel or refractory metal alloy, such as Inconel® or Hastelloy®. The metal mesh now commonly used for diesel exhaust particulate filters is suitable for the porous filter 30.

The heater wires 22 and 24 and fiber optic cable 32 lead to a socket 34 at the glow plug end opposite the ceramic heater shell.

Illustrated in FIGS. 2, 2*a* and 2*b* is a glow plug of an alternative embodiment having a ceramic heater shell 40 with a resistance heater 42 therein. The ceramic heater shell 40 is formed with a plurality of radial pressure access holes 48 in communication with a central axial hole 50 also formed in the ceramic heater shell. Located in the central axial hole 50 is a porous filter 60 of cylindrical shape.

Supporting the ceramic heater shell 40 is a metal heater sleeve 44 having the central axial hole 50 extended there through. Also extending through the metal heater sleeve 44 is a pair of axially directed holes containing the heater wires 52 and 54 leading to the resistance heater 42.

Located within the central axial hole 50 of the metal heater sleeve 44 is a fiber optic pressure sensor 56 laser welded into the hole at 57 and having a sensor diaphragm 58. The entire assembly is supported by the glow plug shell 46.

As above, the heater wires 52 and 54 and fiber optic cable 62 lead to a socket 64 at the glow plug end opposite the ceramic heater shell 40.

Illustrated in FIGS. 3, 3*a* and 3*b* is a glow plug of another alternative embodiment having a metal sheath 70 enclosing a ceramic interior 72 and a coil 69 mounted on an electrode 68. The metal sheath 70 is mounted on a heater sleeve 74 in turn separated from the electrode 68 by a ceramic insert 66. The heater sleeve 74, electrode 68 and ceramic insert 66 are formed with a plurality of radial pressure access holes 78 in communication with a central axial hole 80 also formed in the electrode. Located in the central axial hole 80 is a porous filter 90 of cylindrical shape.

Welded to the electrode 68 at 82 is an electrode tube 84, and located in the electrode tube and central axial hole 80 is a fiber optic pressure sensor 86 having a sensor diaphragm 88. The entire assembly is supported by the glow plug shell 76. The electrode tube 84 and fiber optic cable 92 lead to a socket 94 at the glow plug end opposite the metal sheath 70.

The invention claimed is:

1. In an integrated glow plug and pressure sensor having a passage leading to the pressure sensor, the improvement comprising a porous filter in the passage.

2. The integrated glow plug of claim 1, including a ceramic heater shell and a metal heater sleeve, the metal heater sleeve supporting the ceramic heater shell.

3. The integrated glow plug of claim 2 wherein at least a portion of the passage is located in the metal heater sleeve.

4. The integrated glow plug of claim 2 wherein at least a portion of the passage is located in the ceramic heater shell.

5. The integrated glow plug of claim 1 wherein the porous filter comprises a wire mesh.

6. The integrated glow plug of claim 1 wherein the porous filter comprises a porous ceramic.

7. In an integrated glow plug and pressure sensor having a passage leading to the pressure sensor, the improvement comprising means in the passage to trap combustion deposits.

8. The integrated glow plug of claim 7 wherein the means in the passage burns trapped combustion products in response to heating of the glow plug.

9. The integrated glow plug of claim 7 wherein the means in the passage acts as a heat shield for the pressure sensor.

10. The integrated glow plug of claim 7 wherein the means in the passage damps acoustic high frequency ringing in the passage.

11. In an integrated glow plug and pressure sensor having a passage leading to the pressure sensor, the improvement comprising at least one non-axial pressure access hole communicating with the passage and a porous filter positioned to intercept gases entering the passage from the access hole.

12. The integrated glow plug of claim 11, including a ceramic heater shell supported on a metal heater sleeve and wherein the access hole is formed in the metal heater sleeve.

13. The integrated glow plug of claim 11, including a ceramic heater shell supported on a metal heater sleeve and wherein the access hole is formed in the ceramic heater shell.

14. The integrated glow plug of claim 11, including a metal sheath enclosing an electrode, the metal sheath being supported on a heater sleeve and a ceramic insert separating the electrode from the heater sleeve, and wherein the access hole penetrates the heater sleeve, ceramic insert and electrode.

15. The integrated glow plug of claim 11 wherein the passage is axially located in the glow plug and the pressure sensor is axially located in the passage.

16. The integrated glow plug of claim 15 wherein the access hole comprises a plurality of holes radially intercepting the passage.

* * * * *